US009890488B2

(12) United States Patent
Reed

(10) Patent No.: US 9,890,488 B2
(45) Date of Patent: Feb. 13, 2018

(54) STAIN CLEANING DEVICE

(71) Applicant: Alix B. Reed, Las Vegas, NV (US)

(72) Inventor: Alix B. Reed, Las Vegas, NV (US)

(73) Assignee: Alix B. Reed, Las Vegas, NV (US)

( * ) Notice: Subject to any disclaimer, the term of this patent is extended or adjusted under 35 U.S.C. 154(b) by 0 days.

(21) Appl. No.: 14/489,246

(22) Filed: Sep. 17, 2014

(65) Prior Publication Data

US 2017/0044701 A1 Feb. 16, 2017

(51) Int. Cl.

| | |
|---|---|
| ***D06F 3/02*** | (2006.01) |
| ***D06F 3/00*** | (2006.01) |
| ***D06F 43/00*** | (2006.01) |
| ***A47L 25/08*** | (2006.01) |

(52) U.S. Cl.

CPC ..... *D06F 3/02* (2013.01); *A47L 25/08* (2013.01); *D06F 43/002* (2013.01); *D06F 3/00* (2013.01)

(58) Field of Classification Search

CPC . D06F 3/00; D06F 3/02; D06F 43/002; A47L 25/08

See application file for complete search history.

(56) References Cited

U.S. PATENT DOCUMENTS 2,437,478 A * 3/1948 Pickett, Jr. ..... D06F 43/002 68/20
2,444,728 A * 7/1948 Castoe ..... D06F 43/002 68/240
2,987,906 A * 6/1961 Bourland ..... D06F 43/002 118/264
4,966,292 A * 10/1990 Marino ..... B65D 43/0256 215/256
5,050,754 A * 9/1991 Marino ..... B65D 41/485 215/256
5,402,657 A * 4/1995 Henry, Jr. ..... D06F 43/002 68/200
5,707,163 A * 1/1998 Gregory ..... A47L 25/08 401/10
7,389,658 B2 * 6/2008 Soberg ..... A47L 25/08 68/200
2002/0056165 A1 * 5/2002 Deflander ..... D06F 39/024 8/158
2008/0223419 A1 * 9/2008 Chun ..... D06F 43/002 134/104.2

* cited by examiner

*Primary Examiner* — Joseph L. Perrin
(74) *Attorney, Agent, or Firm* — Kali Law Group, P.C.

(57) ABSTRACT

Stain cleaning devices are presented including: a base forming a tapered cylinder and having a base upper opening and a base lower opening, the base configured for receiving a fabric; and a ring forming a tapered sleeve that is complementary with the base, where the ring includes a ring upper opening and a ring lower opening, and where the ring secures the fabric over the base. In some embodiments, devices further include: an insert disc having a top surface and a bottom surface, where the insert is positioned between the base upper opening and the fabric and where the insert includes, a washboard surface along the top surface and a soaking tray surface along the bottom surface. In some embodiments, the washboard surface includes a texture selected from the group consisting of: a raised cross texture, a raised parallel texture, and a number of raised individual features.

17 Claims, 6 Drawing Sheets

STAIN CLEANING DEVICE

FIELD OF INVENTION

The present invention relates to devices for removing stains from fabrics.

BACKGROUND

There exist, on the market, many stain remover products. Conventional solutions provide a cleaning agent that serves to "loosen" the stain from the fabric or garment. Once the cleaning agent is applied to a stain, the consumer is left to mechanically scrub the stain and then rinse the solution and the stain from the fabric. Common practices include holding the fabric over a sink or placing the fabric on a countertop with an absorbent cloth. In these practices, the consumer must use one hand to hold the fabric and the other hand to apply the cleaning agent and to scrub the stain. Since the fabric is loosely held, it may difficult or impossible to adequately scrub the stain. In addition, some cleaning agents may include chemicals that are skin irritants or toxic. By holding the fabric in a hand, cleaning agents may come into direct contact with the consumer's hands. As such, stain cleaning devices are presented.

SUMMARY

The following presents a simplified summary of some embodiments of the invention in order to provide a basic understanding of the invention. This summary is not an extensive overview of the invention. It is not intended to identify key/critical elements of the invention or to delineate the scope of the invention. Its sole purpose is to present some embodiments of the invention in a simplified form as a prelude to the more detailed description that is presented below.

As such, stain cleaning devices are presented including: a base forming a tapered cylinder and having a base upper opening and a base lower opening, the base configured for receiving a fabric, and a ring forming a tapered sleeve that is complementary with the base, where the ring includes a ring upper opening and a ring lower opening, and where the ring secures the fabric over the base. In some embodiments, devices further include: an insert disc having a top surface and a bottom surface, where the insert is positioned between the base upper opening and the fabric and where the insert includes, a washboard surface along the top surface and a soaking tray surface along the bottom surface. In some embodiments, the washboard surface includes a texture selected from the group consisting of a raised cross texture, a raised parallel texture, and a number of raised individual features. In some embodiments, devices further include: a removable bottom cover positioned along the base lower opening. In some embodiments, the base further includes a number of raised friction features along a surface of the tapered cylinder, where the number of raised friction features extend substantially parallel with the base upper opening and the base lower opening. In some embodiments, the ring further includes a number of raised friction features along a surface of the tapered sleeve. In some embodiments, the base upper opening has a first circumference that is different than a second circumference of the base lower opening. In some embodiments, the base further includes a collapsible portion such that the device may be configured in a collapsed position and an extended position.

In other embodiments, stain cleaning devices are presented including: a base forming a tapered cylinder and having a base upper opening and a base lower opening, the base configured for receiving a fabric; a ring forming a tapered sleeve that is complementary with the base, where the rings includes a ring upper opening and a ring lower opening, and where the ring secures the fabric over the base; and an insert disc having a top surface and a bottom surface, where the insert is positioned between the base upper opening and the fabric and where the insert includes, a washboard surface along the top surface and a soaking tray surface along the bottom surface. In some embodiments, the washboard surface includes a texture selected from the group consisting of: a raised cross texture, a raised parallel texture, and a number of raised individual features. In some embodiments, devices further include: a removable bottom cover positioned along the base lower opening. In some embodiments, the base further includes a number of raised friction features along a surface of the tapered cylinder, where the number of raised friction features extend substantially parallel with the base upper opening and the base lower opening. In some embodiments, the ring further includes a number of raised friction features along a surface of the tapered sleeve. In some embodiments, the base upper opening has a first circumference that is different than a second circumference of the base lower opening. In some embodiments, the base further includes a collapsible portion such that the device may be configured in a collapsed position and an extended position.

In other embodiments, stain cleaning kits are presented including: a base forming a tapered cylinder and having a base upper opening and a base lower opening, the base configured for receiving a fabric; and a ring forming a tapered sleeve that is complementary with the base, where the rings includes a ring upper opening and a ring lower opening, and where the ring secures the fabric over the base; an insert disc having a top surface and a bottom surface, where the insert is positioned between the base upper opening and the fabric and where the insert includes, a washboard surface along the top surface and a soaking tray surface along the bottom surface; and a brush for scrubbing the fabric. In some embodiments, kits further include: a removable bottom cover positioned along the base lower opening. In some embodiments, kits further include a cleaning solution suitable for cleaning the fabric. In some embodiments, kits further include an absorbent swatch for absorbing a stain.

BRIEF DESCRIPTION OF THE DRAWINGS

The present invention is illustrated by way of example, and not by way of limitation, in the figures of the accompanying drawings and in which like reference numerals refer to similar elements and in which.

DETAILED DESCRIPTION

The present invention will now be described in detail with reference to a few embodiments thereof as illustrated in the accompanying drawings. In the following description, numerous specific details are set forth in order to provide a thorough understanding of the present invention. It will be apparent, however, to one skilled in the art, that the present invention may be practiced without some or all of these specific details. In other instances, well known process steps and/or structures have not been described in detail in order to not unnecessarily obscure the present invention.

Embodiments disclosed herein provide consumers with a stain cleaning device that manages a fabric (or garment) during cleaning. Embodiments gently holds and stretches the fabric allowing deep penetration of cleaning agents. In addition, scrubbing may be more gently applied when the fabric is stretched thus extending the useful life of the fabric. Embodiments may be used in a sink basin, on a countertop, or on any working surface convenient to a consumer.

Figure 1:
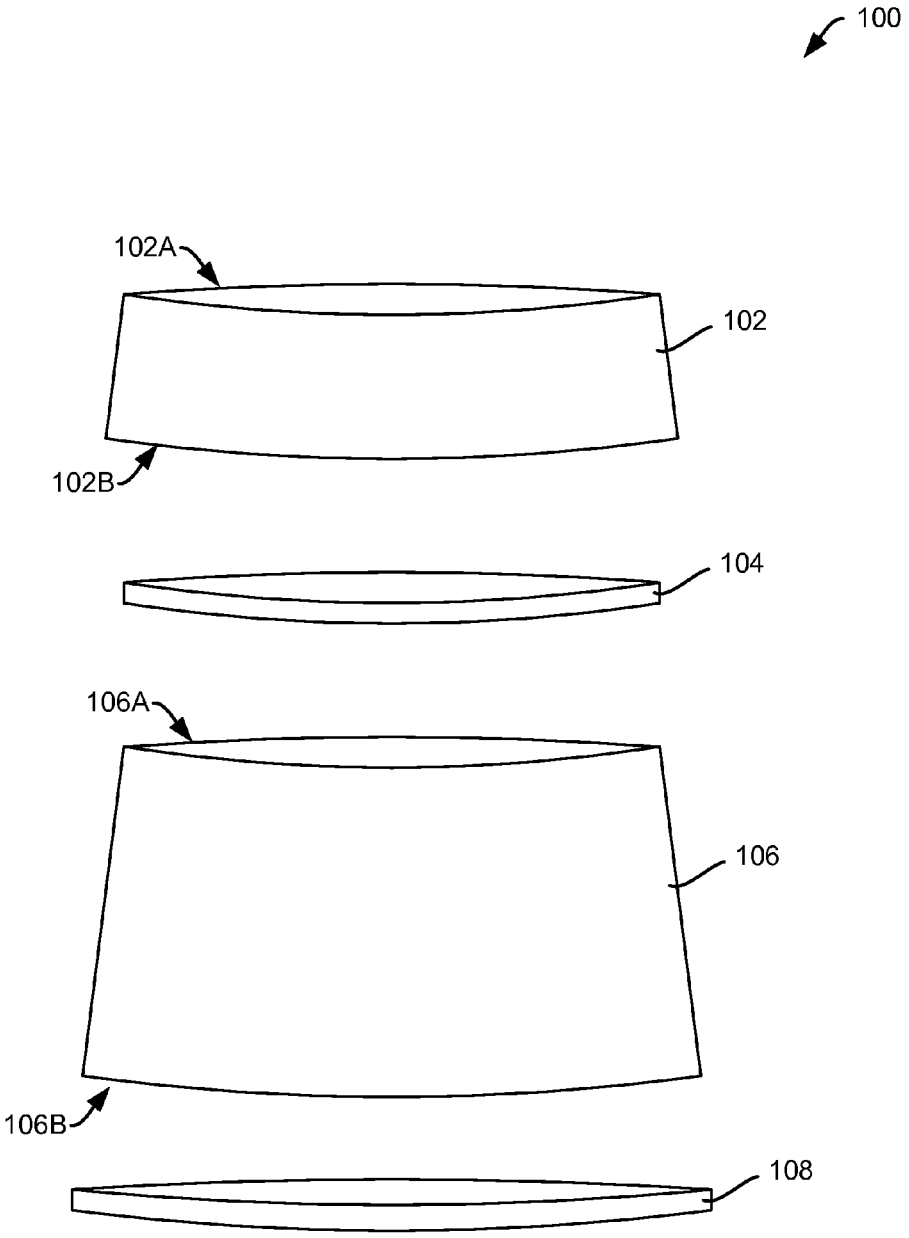
FIG. 1 is an illustrative representation of a stain cleaning device in accordance with embodiments of the present invention.

FIG. 1 is an illustrative representation of a stain cleaning device 100 in accordance with embodiments of the present invention. In particular, as illustrated, stain cleaning device 100 includes ring 102 and base 106. Base 106 forms a tapered cylinder having upper opening 106A and lower opening 106B. Base 106 is configured for receiving a fabric. Embodiments in use will be discussed in further detail below for FIG. 4. It may be noted that base upper opening 106A has a circumference that is different from a circumference of base lower opening 106B. In some embodiments, the base upper opening circumference is smaller than the base lower opening circumference. In embodiments, bases may be manufactured from a number of materials such as a polymeric material, a rigid polymeric material, and a semi-rigid polymeric material.

Further illustrated is ring 102 that forms a tapered sleeve that is complementary with base 106. Tapered sleeve embodiments may be sized to a fabric's thickness as desired by a consumer. Ring 102 includes ring upper opening 102A and ring lower opening 102B. In use, ring 102 secures a fabric over base 106. In embodiments, rings may be manufactured from a number of materials such as: a polymeric material, a rigid polymeric material, a semi-rigid polymetric material, a semi-stretchable polymeric material, and a stretchable polymeric material. In some embodiments, use of a semi-stretchable polymeric material may be particularly useful in accommodating fabric of different stiffness and thickness. In some embodiments, stain cleaning device 100 includes insert disc 104 positioned between base upper opening 104 and a fabric. Insert discs will be discussed in further detail below for FIG. 3. In other embodiments, stain cleaning device 100 includes removable bottom cover 108 positioned along the base lower opening. Removable bottom covers may be useful to contain cleaning agent and liquid flow though in some embodiments. It may be appreciated that utilizing a removable bottom cover may be particularly useful when using stain devices on countertops.

Figure 2:
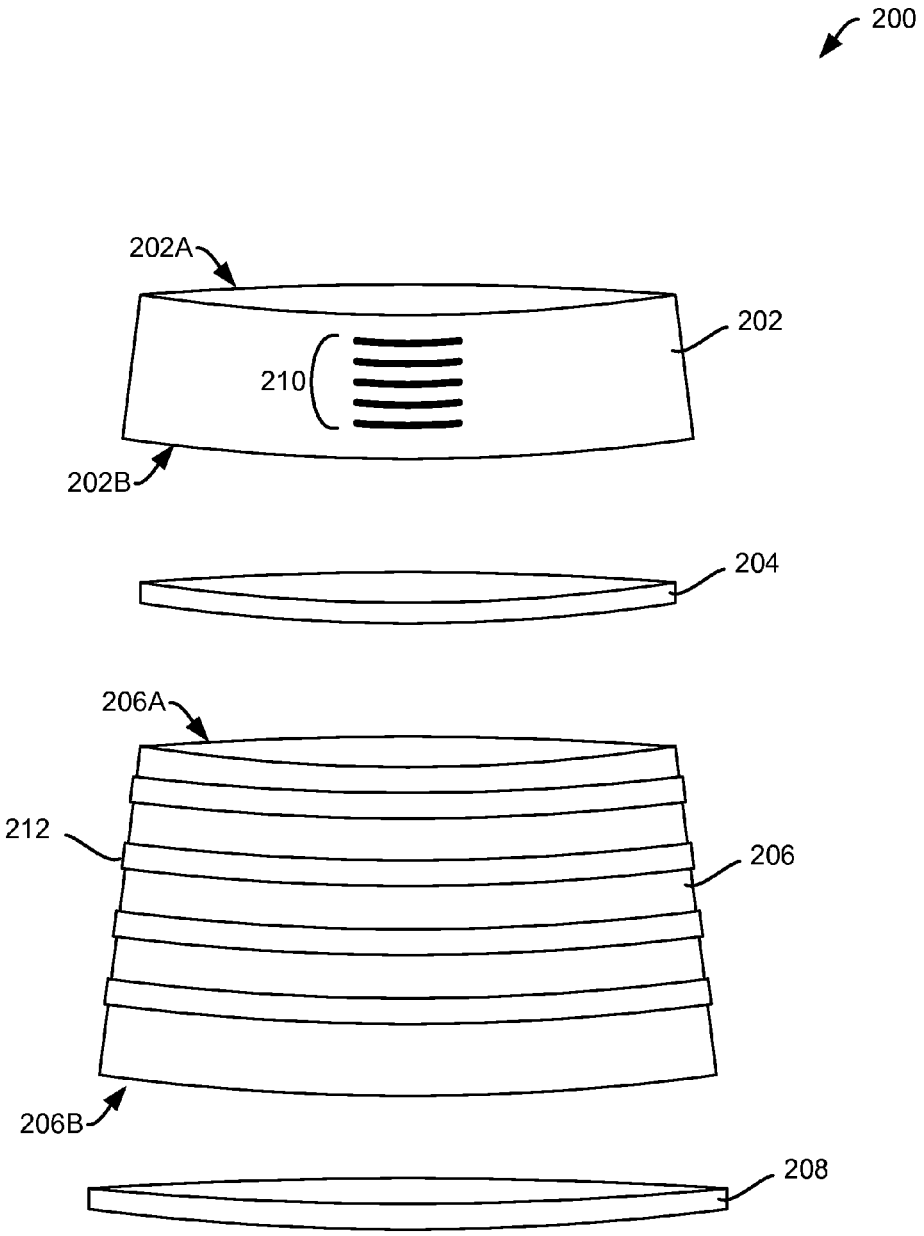
FIG. 2 is an illustrative representation of a stain cleaning device in accordance with embodiments of the present invention.

FIG. 2 is an illustrative representation of a stain cleaning device 200 in accordance with embodiments of the present invention. In particular, as illustrated, stain cleaning device 200 includes ring 202 and base 206. Base 206 forms a tapered cylinder having upper opening 206A and lower opening 206B. Base 206 is configured for receiving a fabric. Embodiments in use will be discussed in further detail below for FIG. 4. It may be noted that base upper opening 206A has a circumference that is different from a circumference of base lower opening 206B. In some embodiments, the base upper opening circumference is smaller than the base lower opening circumference. In some embodiments, base 206 further includes a number of raised friction features 212 along a surface of the tapered cylinder. In embodiments, bases may be manufactured from a number of materials such as: a polymeric material, a rigid polymeric material, and a semi-rigid polymeric material.

Raised friction features may provide an improved gripping surface for receiving a fabric. As illustrated, the raised friction features extend substantially parallel with base upper opening 206A and base lower opening 206B. As may be appreciated, raised friction features may have any number of cross-sectional profiles. As illustrated, raised friction features have a rectangular cross-sectional profile. In some embodiments cross-sectional profiles may include, for example, a circular cross-sectional profile, a semi-circular cross-sectional profile, a square cross-sectional profile, an ovate cross-sectional profile, and a semi-ovate cross-sectional profile without limitation.

Further illustrated is ring 202 that forms a tapered sleeve that is complementary with base 206. Tapered sleeve embodiments may be sized to a fabrics thickness as desired by a consumer. Ring 202 includes ring upper opening 202A and ring lower opening 202B. In use, ring 202 secures a fabric over base 206. In embodiments, rings may be manufactured from a number of materials such as: a polymeric material, a rigid polymeric material, a semi-rigid polymeric material, a semi-stretchable polymeric material, and a stretchable polymeric material. In some embodiments, use of a semi-stretchable polymeric material may be particularly useful in accommodating fabric of different stiffness and thickness. In some embodiments, ring 202 further includes a number of raised friction features 210 along a surface of the tapered sleeve. Raised friction features may provide an improved gripping surface for a consumer's hand. As illustrated, raised friction surfaces cover only a portion of ring 202. However, raised friction surfaces may cover more or less of ring 202 in embodiments without limitation. In addition, raised friction surfaces may include any number of patterns or cross-sectional profiles in embodiments. In some embodiments, stain cleaning device 200 includes insert disc 204 positioned between base upper opening 204 and a fabric. Insert discs will be discussed in further detail below for FIG. 3. In other embodiments, stain cleaning device 200 includes removable bottom 208 cover positioned along the base lower opening. Removable bottom covers may be useful to contain cleaning agent and liquid flow though in some embodiments. It may be appreciated that utilizing a removable bottom cover may be particularly useful when using stain devices on countertops.

Figure 3:
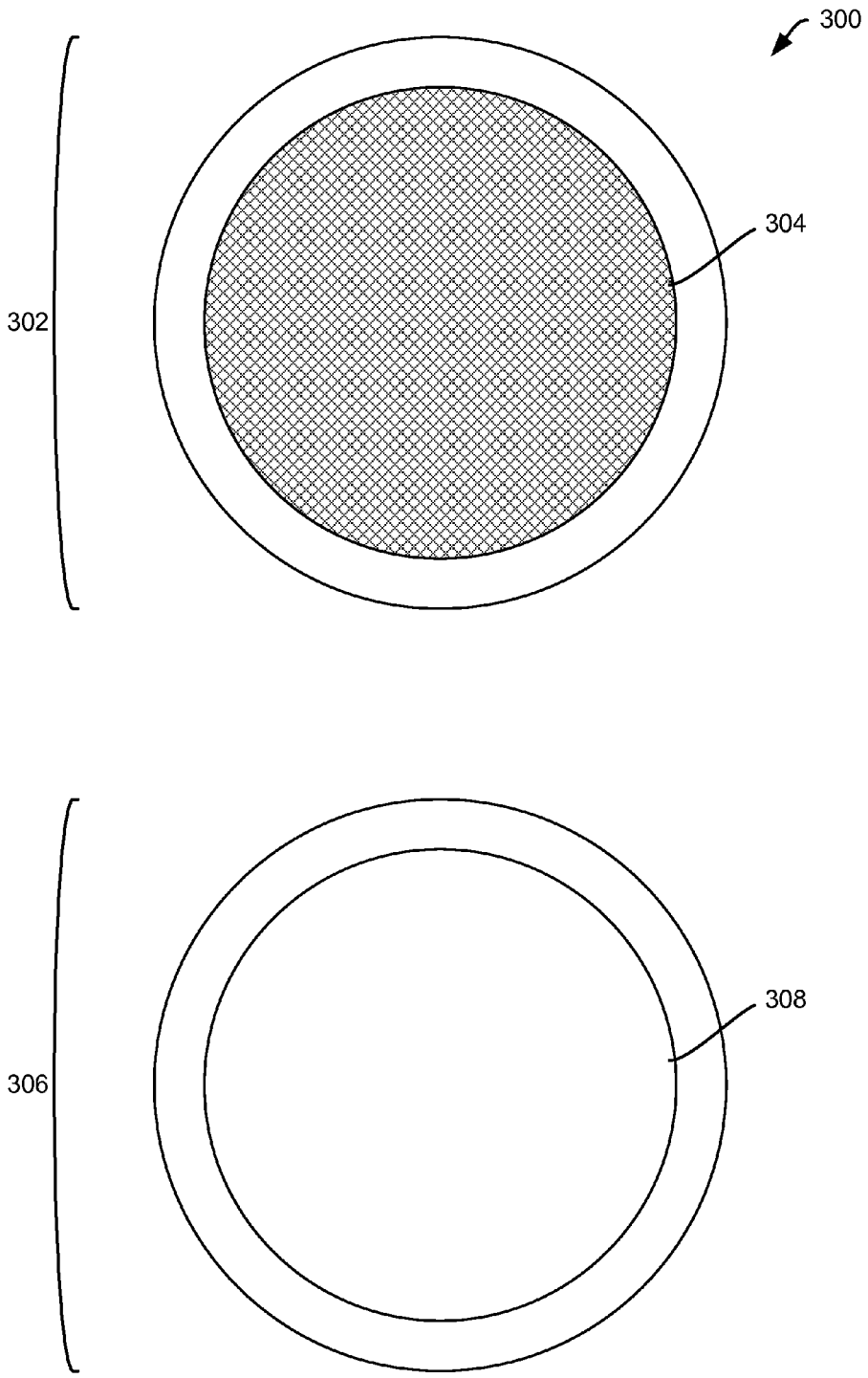
FIG. 3 is an illustrative representation of an insert disc in accordance with embodiments of the present invention.

FIG. 3 is an illustrative representation of an insert disc 300 in accordance with embodiments of the present invention. In particular, FIG. 3 represents a top view and a bottom view of insert disc 104 in FIG. 1 and insert disc 204 in FIG. 2. As noted above, insert discs may be positioned between an base upper opening and a fabric. As illustrated, insert disc 300 includes top surface 302 having washboard surface 304. It may be appreciated that a washboard surface may provide better agitation and cleaning agent penetration resulting in a more effective cleaning surface for fabrics. Washboard surface embodiments may include any number of textures including: a raised cross texture, a raised parallel texture, and a plurality of raised individual features. Further illustrated is bottom surface 306 having soaking tray surface 308. In some examples, fabrics may benefit from additional soaking to allow cleaning agents to adequately penetrate stains. A soaking tray may be utilized to accomplish this benefit.

Figure 4:
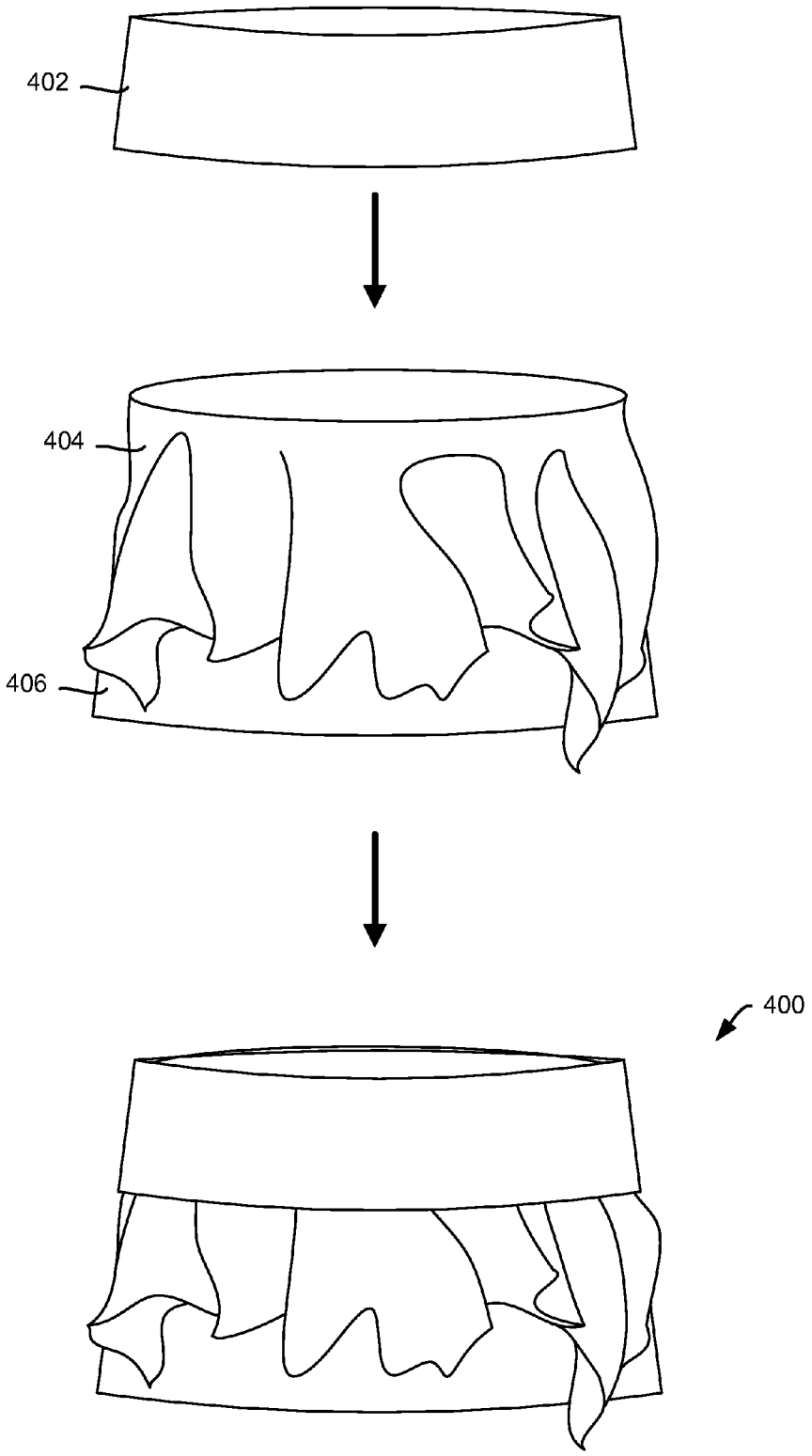
FIG. 4 is an illustrative representation of a stain cleaning device in use in accordance with embodiments of the present invention.

FIG. 4 is an illustrative representation of a stain cleaning device in use in accordance with embodiments of the present invention. Uses illustrated may serve equally well with any embodiments disclosed herein such as for example, stain cleaning device 100 in FIG. 1 and stain cleaning device 200 in FIG. 2. As illustrated, fabric 404 may be placed over base 406. In some examples an insert disc may be provided between fabric 404 and base 406. In other examples, no insert disc may be utilized. Once fabric 404 is in place, with stain positioned over base upper opening, ring 402 may be lowered onto fabric/base to secure the fabric as shown in assembly 400. As ring 402 is placed on base 406, fabric 404 is gently stretched and secured. The amount of stretching may be adjusted depending on how firmly ring 402 is placed on base 406.

Figure 5:
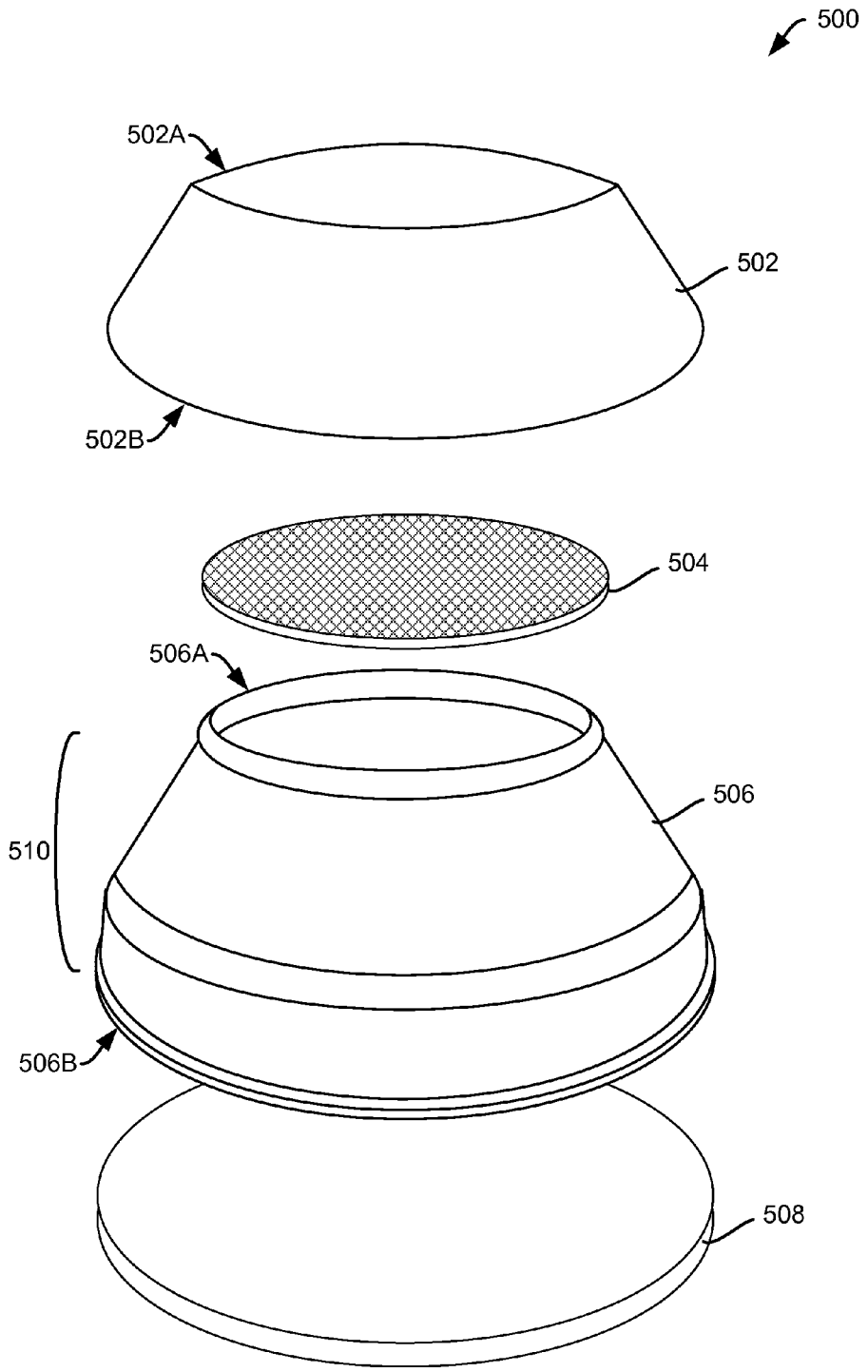
FIG. 5 is an illustrative representation of a collapsible stain cleaning device in accordance with embodiments of the present invention.

FIG. 5 is an illustrative representation of a collapsible stain cleaning device 500 in accordance with embodiments of the present invention. In particular, as illustrated, stain cleaning device 500 includes ring 502 and base 506. Base 506 forms a tapered cylinder having upper opening 506A and lower opening 506B. Base 506 is configured for receiving a fabric. Embodiments in use will be discussed in further detail below for FIG. 4. It may be noted that base upper opening 506A has a circumference that is different from a circumference of base lower opening 506B. In some embodiments, the base upper opening circumference is smaller than the base lower opening circumference. In collapsible stain device embodiments, base 506 may include collapsible portion 510. In embodiments, collapsible portion 510 functions to allow collapsible stain device embodiments to be deployed in a collapsed position and an extended position.

Further illustrated is ring 502 that forms a tapered sleeve that is complementary with base 506. Tapered sleeve embodiments may be sized to a fabric's thickness as desired by a consumer. Ring 502 includes ring upper opening 502A and ring lower opening 502B. In use, ring 502 secures a fabric over base 506. In embodiments, rings may be manufactured from a number of materials such as: a polymeric material, a rigid polymeric material, a semi-rigid polymeric material, a semi-stretchable polymeric material, and a stretchable polymeric material. In some embodiments, use of a semi-stretchable polymeric material may be particularly useful in accommodating fabric of different stiffness and thickness. In some embodiments, stain cleaning device 500 includes insert disc 504 positioned between base upper opening 504 and a fabric. Insert discs are discussed in further detail above for FIG. 3. In other embodiments, stain cleaning device 500 includes removable bottom cover 508 positioned along the base lower opening. Removable bottom covers may be useful to contain cleaning agent and liquid flow though in some embodiments. It may be appreciated that utilizing a removable bottom cover may be particularly useful when using stain devices on countertops.

Figure 6:
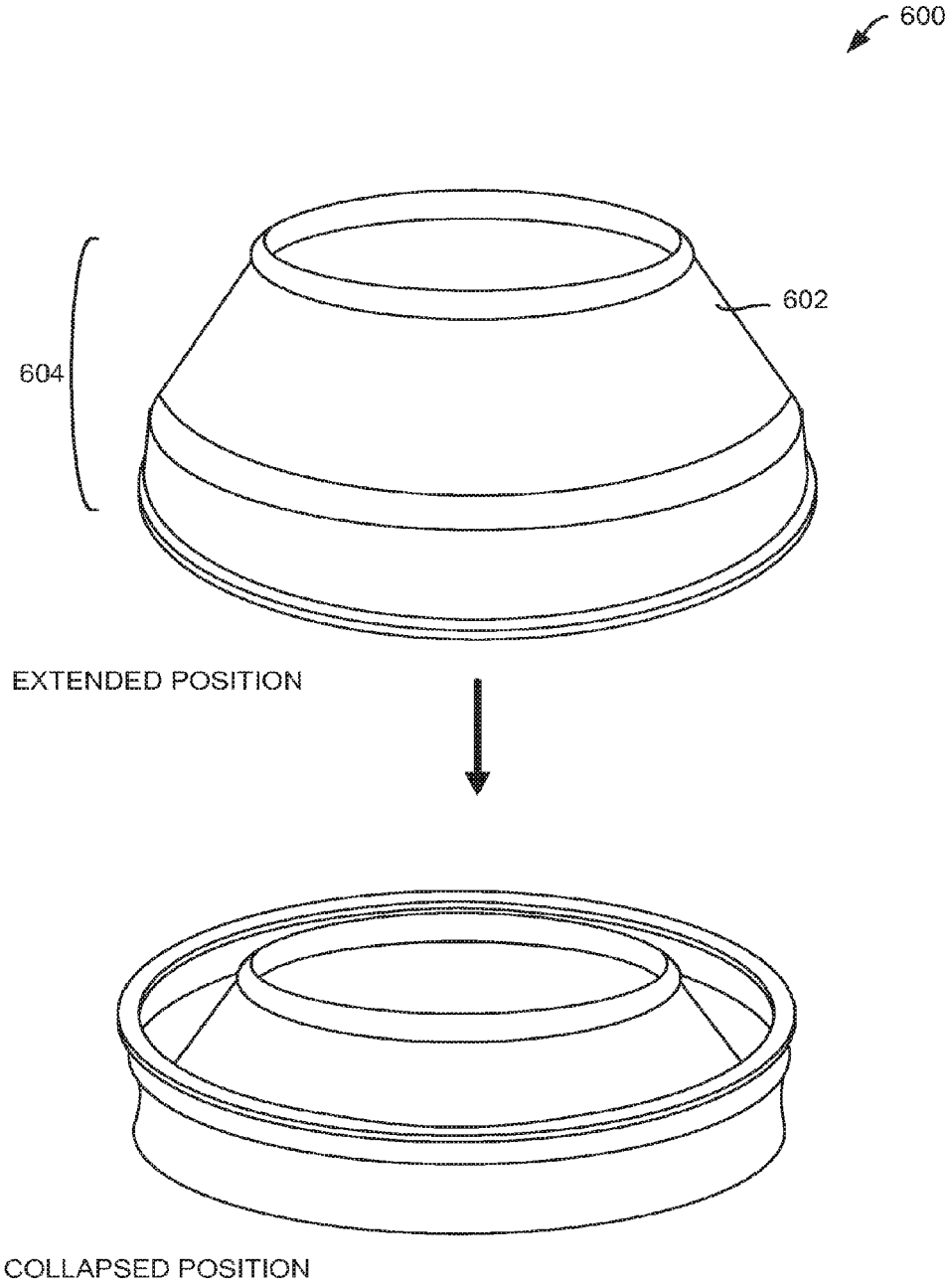
FIG. 6 is an illustrative representation of a collapsible stain cleaning device in accordance with embodiments of the present invention.

FIG. 6 is an illustrative representation of a collapsible stain cleaning device 600 in accordance with embodiments of the present invention. As noted above, in collapsible stain device embodiments, base 602 may include collapsible portion 604. In embodiments, collapsible portion 604 functions to allow collapsible stain device embodiments to be deployed in a collapsed position and an extended position as illustrated. It may be appreciated that collapsible stain cleaning devices may be manufactured from any of a number of polymeric compounds and siliconized polymeric compounds without limitation.

In some additional embodiments not illustrated, a netting sleeve may be utilized to contain fabric not captured by stain device embodiments so that the extra material may be properly managed. Netting sleeves may be attached with bases in any manner known in the art without departing from embodiments provided herein. In one embodiment, a netting sleeve includes a drawstring for attaching the netting sleeve along the circumference of the base.

Kits

In embodiments, it may be useful to provide a kit for cleaning fabrics. Such kits may include in any combination the following items.

A base;
A ring;
An insert disc;
A brush;
A removable bottom cover;
A cleaning solution; and
An absorbent swatch.

In a first example, a kit embodiment may include; a base and a ring. In another example, a kit embodiment may include; a base, a ring, and an insert disc. Thus a kit embodiment includes at least a base and a ring and may be supplemented by any or all of the above referenced items in any combination without limitation.

While this invention has been described in terms of several embodiments, there are alterations, permutations, and equivalents, which fall within the scope of this invention. It should also be noted that there are many alternative ways of implementing the methods and apparatuses of the present invention. Furthermore, unless explicitly stated, any method embodiments described herein are not constrained to a particular order or sequence. Further, the Abstract is provided herein for convenience and should not be employed to construe or limit the overall invention, which is expressed in the claims. It is therefore intended that the following appended claims be interpreted as including all such alterations, permutations, and equivalents as fall within the true spirit and scope of the present invention.

What is claimed is:

1. A stain cleaning device comprising:

a base forming a tapered cylinder and having a base upper opening and a base lower opening, the base configured for receiving a fabric;

a ring forming a tapered sleeve that is complementary with the base, wherein the ring includes a ring upper opening and a ring lower opening, and wherein the ring secures the fabric over the base such that the fabric is directly accessible by a user through the ring; and a circular insert disc having a top surface and a bottom surface, wherein the insert is positioned between the base upper opening and the fabric and wherein the insert includes, a washboard surface along the top surface, wherein the washboard surface is concentric with the circular insert disc, and a soaking tray surface along the bottom surface, wherein the soaking tray surface is concentric with the circular insert disc.

2. The device of claim 1, wherein the washboard surface includes a texture selected from the group consisting of: a raised cross texture, a raised parallel texture, and a plurality of raised individual features.

3. The device of claim 1, further comprising:

a removable bottom cover positioned along the base lower opening.

4. The device of claim 1, wherein the base further includes a plurality of raised friction features along a surface of the tapered cylinder, wherein the plurality of raised friction features extend substantially parallel with the base upper opening and the base lower opening.

5. The device of claim 1, wherein the ring further includes a plurality of raised friction features along a surface of the tapered sleeve.

6. The device of claim 1, wherein the base upper opening has a first circumference that is different than a second circumference of the base lower opening.

7. A stain cleaning device comprising:

a base forming a tapered cylinder and having a base upper opening and a base lower opening, the base configured for receiving a fabric;

a ring forming a tapered sleeve that is complementary with the base, wherein the rings includes a ring upper opening and a ring lower opening, and wherein the ring secures the fabric over the base such that the fabric is directly accessible by a user through the ring; and a circular insert disc having a top surface and a bottom surface, wherein the insert is positioned between the base upper opening and the fabric and wherein the insert includes, a washboard surface along the top surface, wherein the washboard surface is concentric with the circular insert disc, and a soaking tray surface along the bottom surface, wherein the soaking tray surface is concentric with the circular insert disc.

8. The device of claim 7, wherein the washboard surface includes a texture selected from the group consisting of: a raised cross texture, a raised parallel texture, and a plurality of raised individual features.

9. The device of claim 7, further comprising:

a removable bottom cover positioned along the base lower opening.

10. The device of claim 7, wherein the base further includes a plurality of raised friction features along a surface of the tapered cylinder, wherein the plurality of raised friction features extend substantially parallel with the base upper opening and the base lower opening.

11. The device of claim 7, wherein the ring further includes a plurality of raised friction features along a surface of the tapered sleeve.

12. The device of claim 7, wherein the base upper opening has a first circumference that is different than a second circumference of the base lower opening.

13. A stain cleaning kit comprising:

a base forming a tapered cylinder and having a base upper opening and a base lower opening, the base configured for receiving a fabric;

a ring forming a tapered sleeve that is complementary with the base, wherein the rings includes a ring upper opening and a ring lower opening, and wherein the ring secures the fabric over the base such that the fabric is directly accessible by a user through the ring;

a circular insert disc having a top surface and a bottom surface, wherein the insert is positioned between the base upper opening and the fabric and wherein the insert includes, a washboard surface along the top surface, wherein the washboard surface is concentric with the circular insert disc, and a soaking tray surface along the bottom surface, wherein the soaking tray surface is concentric with the circular insert disc; and a brush for scrubbing the fabric.

14. The kit of claim 13, further comprising:

a removable bottom cover positioned along the base lower opening.

15. The kit of claim 13, wherein the washboard surface is a surface selected from the group consisting of: a raised cross texture, a raised parallel texture, and a plurality of raised individual features.

16. The kit of claim 13, further comprising:

a cleaning solution suitable for cleaning the fabric.

17. The kit of claim 13, further comprising:

an absorbent swatch for absorbing a stain.

* * * * *